US007725069B2

(12) United States Patent
Kawahara et al.

(10) Patent No.: US 7,725,069 B2
(45) Date of Patent: May 25, 2010

(54) IMAGE FORMING APPARATUS AND PROCESS UNIT FOR EFFECTIVELY APPLYING LUBRICANT AND CLEANING AN IMAGE CARRIER

(75) Inventors: Shinichi Kawahara, Tokyo (JP); Kohsuke Yamamoto, Kanagawa (JP); Takehide Mizutani, Kanagawa (JP)

(73) Assignee: Ricoh Company Limited, Tokyo (JP)

( * ) Notice: Subject to any disclaimer, the term of this patent is extended or adjusted under 35 U.S.C. 154(b) by 171 days.

(21) Appl. No.: 11/853,529

(22) Filed: Sep. 11, 2007

(65) Prior Publication Data

US 2008/0063447 A1 Mar. 13, 2008

(30) Foreign Application Priority Data

Sep. 12, 2006 (JP) ..... 2006-246245
Feb. 20, 2007 (JP) ..... 2007-039250

(51) Int. Cl.
*G03G 21/00* (2006.01)

(52) U.S. Cl. ..... 399/346

(58) Field of Classification Search ..... 399/175, 399/287, 346, 353; 430/119.8, 119.85, 126.2
See application file for complete search history.

(56) References Cited

U.S. PATENT DOCUMENTS

| | | | | |
|---|---|---|---|---|
| 2,317,485 | A * | 4/1943 | Rider | 15/167.1 |
| 6,118,964 | A | 9/2000 | Kojima et al. | |
| 7,035,582 | B2 | 4/2006 | Suda et al. | |
| 7,209,698 | B2 | 4/2007 | Tawada et al. | |
| 2004/0185762 | A1 * | 9/2004 | Turch et al. | 451/490 |
| 2005/0084304 | A1 | 4/2005 | Kataoka et al. | |
| 2005/0232666 | A1 | 10/2005 | Ojimi et al. | |
| 2006/0127147 | A1 * | 6/2006 | Ueno | 399/353 |
| 2006/0194662 | A1 | 8/2006 | Hozumi et al. | |
| 2007/0059067 | A1 | 3/2007 | Tanaka et al. | |
| 2007/0068738 | A1 | 3/2007 | Kawahara et al. | |
| 2007/0183824 | A1 | 8/2007 | Suda et al. | |

FOREIGN PATENT DOCUMENTS

| | | |
|---|---|---|
| JP | 4-20304 | 1/1992 |

(Continued)

OTHER PUBLICATIONS

Machine Translation of JP 2006-036176 A.*

(Continued)

*Primary Examiner*—David M Gray
*Assistant Examiner*—Gregory H Curran
(74) *Attorney, Agent, or Firm*—Onlon, Spivak, McClelland, Maier & Neustadt, L.L.P.

(57) ABSTRACT

An image forming apparatus includes an image carrier configured to carry an image on a surface thereof, a cleaning unit including a cleaning blade and configured to remove residual toner remaining on the surface of the image carrier with the cleaning blade, and an application unit including a brush roller having a modified cross-section fiber and configured to use the brush roller to scrape molded lubricant into scraped lubricant and apply the scraped lubricant to the image carrier. A process cartridge is provided to the image forming apparatus and integrally includes the image carrier, the cleaning unit, the application unit, and at least one of a charging unit and a developing unit in a single unit.

15 Claims, 8 Drawing Sheets

FOREIGN PATENT DOCUMENTS

| | | | |
|---|---|---|---|
| JP | 6-57175 | | 3/1994 |
| JP | 6-82227 | | 3/1994 |
| JP | 6-282205 | | 10/1994 |
| JP | 7-60273 | | 3/1995 |
| JP | 7-86697 | | 3/1995 |
| JP | 8-160819 | | 6/1996 |
| JP | 9-34330 | | 2/1997 |
| JP | 10-073983 | | 3/1998 |
| JP | 2769917 | | 4/1998 |
| JP | 11-133668 | | 5/1999 |
| JP | 11-184340 | | 7/1999 |
| JP | 3009268 | | 12/1999 |
| JP | 2002-105810 | | 4/2002 |
| JP | 3344169 | | 8/2002 |
| JP | 2002-309446 | | 10/2002 |
| JP | 2002-309447 | | 10/2002 |
| JP | 2002-309448 | | 10/2002 |
| JP | 2002-309449 | | 10/2002 |
| JP | 2002-372838 | | 12/2002 |
| JP | 2003-57920 | | 2/2003 |
| JP | 2004-333961 | | 11/2004 |
| JP | 2005-264399 | | 9/2005 |
| JP | 2005-275166 | | 10/2005 |
| JP | 2006-9177 | | 1/2006 |
| JP | 2006-18009 | | 1/2006 |
| JP | 2006036176 | A * | 2/2006 |
| JP | 2006-58694 | | 3/2006 |
| JP | 2006-91415 | | 4/2006 |
| JP | 2006-152513 | | 6/2006 |

OTHER PUBLICATIONS

Machine Translation of JP 2005-264399 A.*

* cited by examiner

IMAGE FORMING APPARATUS AND PROCESS UNIT FOR EFFECTIVELY APPLYING LUBRICANT AND CLEANING AN IMAGE CARRIER

CROSS-REFERENCE TO RELATED APPLICATIONS

The present patent application claims priority under 35 U.S.C. §119 from Japanese Patent Applications No. 2006-246245 filed on Sep. 12, 2006 and No. 2007-039250 filed on Feb. 20, 2007 in the Japan Patent Office, the contents and disclosures of which are hereby incorporated by reference herein in their entirety.

BACKGROUND OF THE INVENTION

1. Field of the Invention

Exemplary embodiments of the present invention generally relate to an image forming apparatus and a process unit included in the image forming apparatus, and more particularly, to an image forming apparatus that effectively applies lubricant scraped from a solid lubricant onto an image carrier and removes residual toner from the image carrier, and a process unit that is included in the image forming apparatus.

2. Discussion of the Related Art

Recently, color image forming apparatuses using electrophotographic methods have come into widespread use. Digitalized images are now widely available, and as a result printed images are required to have higher image definitions. While research aimed at higher image resolution and gradient is being undertaken, research on the toner that makes visible an electrostatic latent image is directed toward making the toner particles more spherical in shape and with a smaller particle diameter, to form images having higher definition.

Examples of proposed methods for preparing toner having a substantially spherical shape and a small particle diameter include a method of using powdered toner having circular particles with a specific particle diameter distribution, a suspension polymerization method, a method in which a binder resin and a colorant are mixed in a solvent that does not blend with water and dissolved and dispersed in an aqueous medium under a dispersion stabilizer, a method in which a binder resin including a partially modified resin and a colorant are mixed in an organic solvent and dissolved and dispersed in an aqueous medium to cause a polyaddition reaction of the modified resin, and so forth. Such toner having a substantially spherical particle shape and a small particle diameter can enhance image quality and fluidity.

Since toner particles of small size and a spherical shape are reproduced faithfully, they are suitable for obtaining images having high definition. At the same time, however, such toner of small particle size and spherical shape can easily slip through a gap formed between a cleaning blade provided in a cleaning unit and a photoconductor and onto a surface of the photoconductor. Due to the spherical surface of the toner particle, the surface of the photoconductor cannot be easily cleaned, and the residual toner particles are scattered in the image forming apparatus to contaminate an image forming component such as a charging roller. As a result, a defective image having background fogging may be produced.

To eliminate the above-described circumstance an electrophotographic image forming method has been proposed, in which a cleaning member is included for cleaning or removing residual toner on a photoconductor by using an elastic rubber blade after transferring a toner image onto a recording medium, zinc stearate is incorporated in the toner in an amount ranging from approximately 0.01% to approximately 0.5% by toner weight, and the elastic rubber blade is substantially held on a contacting surface side of a cleaning blade on the photoconductor by a supporting member for fixing the elastic rubber blade on the cleaning member.

However, when the zinc stearate is added to the toner, while a high-density image area may receive a great amount of toner and a sufficient amount of zinc stearate may be supplied to the photoconductor, a less sufficient amount of toner may be supplied to a low-density image area and the amount of toner may not be sufficient. That is, a layer of the toner including the zinc stearate applied on the surface of the toner becomes uneven depending on a condition of an image to be developed, resulting in a defective image.

Further, a different technique has been proposed for a related-art image forming apparatus that includes a photoconductor that carries a latent image on a surface thereof, a charging unit that includes a charging member disposed in contact with the surface of the photoconductor or disposed opposite thereto in a vicinity of the surface thereof to charge the surface of the photoconductor, an optical writing unit that emits light and irradiates the surface of the photoconductor to form a latent image on the surface thereof, a developing unit that supplies toner onto the latent image to develop the latent image into a visible toner image, a transfer unit that produces a transfer electrical field between the photoconductor and a surface moving member contacting and moving on the surface of the photoconductor so as to transfer the toner image formed on the surface of the photoconductor onto a recording medium sandwiched between the photoconductor and the surface moving member or onto the surface moving member, and a cleaning unit that removes residual toner remaining on the surface of the photoconductor. The related-art image forming apparatus further includes an application unit including a brush roller that applies lubricant to the surface of the photoconductor to use a technique in which the brush roller slidably moves on a solid or molded lubricant to scrape lubricant from the solid lubricant and applies the scraped lubricant onto the surface of the photoconductor. The brush roller is disposed facing the solid or molded lubricant and supported by a pressing member such as a spring so as to bite a given amount into the solid or molded lubricant. When rotating, the brush roller slidably moves on the surface of the solid lubricant to scrape lubricant from the solid lubricant, and applies the scraped lubricant onto the surface of the photoconductor.

As a contact pressure force of the solid lubricant against the brush roller increases, the extent to which the brush roller bites into the solid lubricant also increases, thereby supplying a more sufficient amount of lubricant to the photoconductor and performing a more stable cleaning operation but also increasing the rotational load of the brush roller. As a result, a life of a drive unit or member of the brush roller may be shortened, costs of motors and power consumption may increase due to an increase of a motor torque, banding may be generated due to rotation vibration of the brush roller, and other disadvantages may be caused.

SUMMARY OF THE INVENTION

Exemplary aspects of the present invention have been made in view of the above-described circumstances, and provide an image forming apparatus that can effectively apply lubricant onto an image carrier and remove residual toner from the image carrier.

Other exemplary aspects of the present invention provide a process cartridge can be included in the above-described image forming apparatus.

In one exemplary embodiment, an image forming apparatus includes an image carrier configured to carry an image on a surface thereof, a cleaning unit including a cleaning blade and configured to remove residual toner remaining on the surface of the image carrier with the cleaning blade, an application unit including a brush roller having a modified cross-section fiber and configured to use the brush roller to scrape molded lubricant into scraped lubricant and apply the scraped lubricant onto the surface of the image carrier.

The brush roller of the application unit may be configured to include a fiber part having a fibrous member and an elastic part having an elastic member, and the fibrous member of the fiber part may have a thickness in a range of from approximately 1.5 T to approximately 4 T.

The brush roller of the application unit may be configured to include a fiber part having a fibrous member and an elastic part having an elastic member, and the elastic member of the elastic part may have an outer diameter smaller than an outer diameter of the fibrous member of the fiber part.

The brush roller may be configured to include a first fiber part having a first fibrous member and a second fiber part having a second fibrous member, and the first fibrous member of the first fiber part may have a thickness is smaller than a thickness of the second fibrous member of the second fiber part and within a range of from approximately 1.5 T to approximately 4 T.

The second fibrous member of the second fiber part may be shorter in length than the first fibrous member of the first fiber part.

The image carrier may have a coefficient of friction equal to or less than 0.4.

The lubricant may include fatty acid metal salts having metallic materials and fatty acids.

A ratio of a circumferential velocity of the photoconductor to a circumferential velocity of the brush roller may be in a range of from 0.8:1 to 1.2:1.

The image forming apparatus may be configured to use toner containing particles having an average circularity of from approximately 0.92 to approximately 1.00.

The image forming apparatus may be configured to use toner containing particles having a shape factor SF-1 in a range of from approximately 100 to approximately 180, and a shape factor SF-2 in a range of from approximately 100 to approximately 180.

The image forming apparatus may be configured to use toner containing particles having a volume-based average particle diameter from approximately 3 μm to approximately 8 μm and a distribution of from approximately 1.00 to approximately 1.40. The distribution may be defined by a ratio of the volume-based average particle diameter to a number-based average diameter.

The image forming apparatus may be configured to use toner containing particles having a ratio of a major axis r1 to a minor axis r2 of from approximately 0.5 to approximately 1.0, and a ratio of a thickness r3 to the minor axis r2 of from approximately 0.7 to approximately 1.0, and satisfy a relation of "$r1 \geqq r2 \geqq r3$."

The image forming apparatus may be configured to use toner containing particles obtained from at least one of an elongation and a crosslinking reaction of toner composition comprising a polyester prepolymer having a function group including a nitrogen atom, a polyester, a colorant, and a releasing agent in an aqueous medium under resin fine particles.

Further, in one exemplary embodiment, a process unit is detachable from an image forming apparatus and integrally includes an image carrier configured to carry an image on a surface thereof, an application unit including a roller and configured to use the roller to scrape molded lubricant into scraped lubricant and apply the scraped lubricant to the image carrier, the roller including a fiber part and an elastic part mounted thereon and a fibrous member of the fiber part having a thickness in a range of from approximately 1.5 T to approximately 4.0 T and including a modified cross-section fiber, a cleaning unit including a cleaning blade and configured to remove residual toner on the surface of the image carrier with the cleaning blade, and at least one of a charging unit configured to uniformly charge the surface of the image carrier and a developing unit configured to develop an image formed on the surface of the image carrier into a visible toner image.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
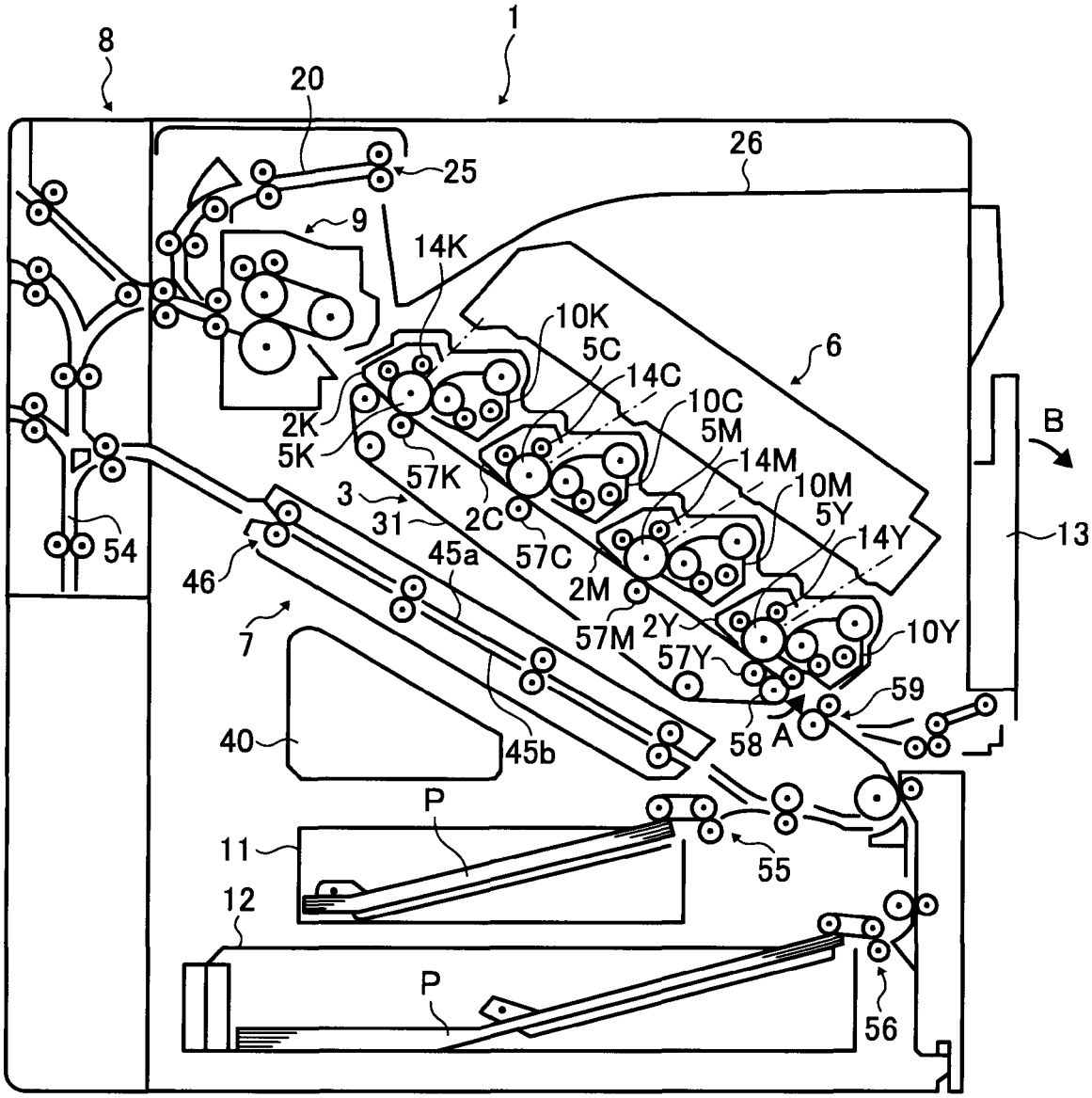
FIG. 1 is a schematic structure of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, an image forming apparatus 1 is shown as one example of an electro-photographic image forming apparatus according to an embodiment of the present invention. Although the image forming apparatus 1 of FIG. 1 is configured to form a color image with toners of four different colors, such as yellow (Y), magenta (M), cyan (C), and black (K), the image forming apparatus can be a monochromatic printer, a copier, a facsimile machine and other image forming apparatus.

The image forming apparatus 1 can include four image forming units 2Y, 2M, 2C, and 2K as an image forming mechanism, an image transfer unit 3 as a transfer mechanism, a writing unit 6 as a writing mechanism, a fixing unit 9 as a fixing mechanism, a toner storing unit 40 as a toner feeding mechanism, and sheet feeding cassettes 11 and 12 as a sheet feeding mechanism.

The four image forming units 2Y, 2M, 2C, and 2K include four photoconductors 5Y, 5M, 5C, and 5K, respectively, four charging units 14Y, 14M, 14C, and 14K, respectively, and four developing units 10Y, 10M, 10C, and 10K. The four image forming units 2Y, 2M, 2C, and 2K can have similar structures and functions, except that the toners are different colors to form yellow images, magenta images, cyan images, and black images, respectively.

The four image forming units 2Y, 2M, 2C, and 2K are separately arranged at positions having different heights or elevations, in a stepped manner, and are separately detachable from the image forming apparatus 1.

The photoconductors 5Y, 5M, 5C, and 5K separately receive respective light laser beams emitted by the writing unit 6, such that electrostatic latent images are formed on the surfaces of the four photoconductors 5Y, 5M, 5C, and 5K.

The charging units 14Y, 14M, 14C, and 14K include respective charging rollers (see a charging roller 14*a* in FIG. 2) are held in contact with the photoconductors 5Y, 5M, 5C, and 5K to charge respective surfaces of the photoconductors 5Y, 5M, 5C, and 5K.

The developing units 10Y, 10M, 10C, and 10K are separately disposed in a vicinity of or adjacent the image forming units 2Y, 2M, 2C, and 2K, respectively. The developing units 10Y, 10M, 10C, and 10K store the different colored toners for the respective image forming units 2Y, 2M, 2C, and 2K.

In this embodiment, the developing units 10Y, 10M, 10C, and 10K can have structures and functions similar to one another, and respectively contain a two-component type developer including a toner and a carrier mixture. More specifically, the developing units 10Y, 10M, 10C, and 10K respectively use yellow toner, magenta toner, cyan toner, and black toner.

Each of the developing units 10Y, 10M, 10C, and 10K includes a developing roller, not shown, facing the respective photoconductors 5Y, 5M, 5C, and 5K, a screw conveyor, not shown, for conveying the developer while agitating the developer, and a toner content sensor, not shown.

The developing roller includes a rotatable sleeve and a stationary magnet roller disposed in the rotatable sleeve.

The transfer unit 3 including an image transfer belt 31 is located or disposed below the image forming units 2Y, 2M, 2C, and 2K (substantially at the center of the image forming apparatus 1). The image transfer belt 31 is passed over or surrounds a plurality of rollers including a paper attracting roller 58. The image transfer belt 31 is held in contact with the photoconductors 5Y, 5M, 5C, and 5K and travels in a same direction as that in which the photoconductors 5Y, 5M, 5C, and 5K rotate, as indicated by arrow A in FIG. 1.

Four primary transfer mechanisms 57Y, 57M, 57C, and 57K are disposed inside a loop of the image transfer belt 31 to face the respective photoconductors 5Y, 5M, 5C, and 5K, which are accommodated in the image forming units 2Y, 2M, 2C, and 2K.

The toner storing unit 40 stores and supplies toner to each of the developing units 10Y, 10M, 10C, and 10K in accordance with an output of the toner content sensor.

Carrier particles generally include a core material or the core material provided with a coating layer. Magnetic material such as ferrite and magnetite may be used as the core material of the resin-coated carrier particles. A particle size of the core material may preferably be approximately 20 μm to approximately 65 μm, more preferably be approximately 30 μm to approximately 60 μm. The material for forming a carrier coating layer may be any one of styrene resins, acrylic resins, fluorine contained resins, silicone resins, and mixtures or copolymers of the above-described resins. The carrier coating layer may be formed by spraying the resin on the surfaces of the particles of the core material or by dipping the particles in the resin as used in a conventional method.

The writing unit 6 is provided at a position above the image forming units 2Y, 2M, 2C, and 2K. The writing unit 6 has four laser diodes (LDs), a polygon scanner, and lenses and mirrors. The four laser diodes (LDs) serve as light sources and irradiate the respective photoconductors 5Y, 5M, 5C, and 5K with respective imagewise laser light beams to form electrostatic latent images thereon. The polygon scanner including a polygon mirror having six surfaces and a polygon motor. Lenses such as f-theta lenses, elongate WTLs, and other lenses, and mirrors are provided in an optical path of the respective laser light beams. The laser light beams emitted from the laser diodes are deflected by the polygon scanner to irradiate the photoconductors 5Y 5M, 5C, and 5K.

The sheet feeding mechanism is arranged in a lower portion of the image forming apparatus 1, and includes the sheet feeding cassettes 11 and 12, sheet separation and feed units 55 and 56 assigned to the sheet feeding cassettes 11 and 12, respectively, and a pair of registration rollers 59. The sheet feeding cassettes 11 and 12 are loaded with a stack of sheets of particular size including a recording paper P. When an image forming operation is performed, the recording paper P is fed from one of the sheet feeding cassettes 11 and 12 and is conveyed toward the pair of registration rollers 59.

The sheet feeding mechanism also includes a duplex print unit 7, a reverse unit 8, a manual sheet feeding tray 13, a reverse discharging path 20, a sheet discharging roller pair 25 and a discharging tray 26.

The duplex print unit 7 is provided at a position below the image transfer belt 31. In addition, the reverse unit 8 is provided on a left side of the image forming apparatus 1 of FIG. 1, which discharges a recording paper P on which an image is formed after reversing the recording paper P or feeds the recording paper P to the duplex print unit 7.

The duplex print unit 7 includes a pair of guide plates 45*a* and 45*b*, and four pairs of sheet feeding rollers 46. When a duplex image forming operation is performed, the duplex print unit 7 receives the recording paper P on one side of which an image is formed and which is fed to the duplex print unit 7 after the recording paper P is switched back at a reverse transporting passage 54 of the reverse unit 8. The duplex print unit 7 then transports the recording paper P to the sheet feeding mechanism.

The reverse unit 8 includes plural pairs of feeding rollers and plural pairs of feeding guides of the reverse transporting passage 54. As described above, the reverse unit 8 feeds the recording paper P on which an image is formed to the duplex print unit 7 after reversing the recording paper P or discharges the recording paper P without reversing the recording paper P.

The manual sheet feeding tray 13 is mounted on the right side of the image forming apparatus 1 of FIG. 1. The manual sheet feeding tray 13 is openable in a direction indicated by arrow B. After opening the manual sheet feeding tray 13, an operator of the image forming apparatus 1 may feed sheets by hand.

The fixing unit 9 serving as the fixing mechanism is positioned between the image transfer belt 31 and the reverse unit 8 for fixing an image formed on the recording paper P. The reverse discharge path 20 branches off a downstream side of the fixing unit 9 in the direction in which the recording paper P is conveyed, so that the recording paper P conveyed into the reverse discharge path 20 is driven out to the discharging tray 26 by a sheet discharging roller pair 25.

A full-color image forming operation of the image forming apparatus 1 is now described.

When the image forming apparatus 1 receives full color image data, each of the photoconductors 5Y, 5M, 5C, and 5K rotates in a clockwise direction in FIG. 1 and is uniformly charged with the corresponding charging rollers 14Y, 14M, 14C, and 14K. The writing unit 6 irradiates the photoconductors 5Y, 5M, 5C, and 5K of the image forming units 2Y, 2M, 2C, and 2K with the laser light beams corresponding to the respective color image data, resulting in formation of electrostatic latent images, which correspond to the respective color image data, on respective surfaces of the photoconductors 5Y, 5M, 5C, and 5K. The electrostatic latent images formed on the respective photoconductors 5Y, 5M, 5C, and 5K are developed with the respective developers including respective color toners at the respective developing units 10Y, 10M, 10C, and 10K, resulting in formation of magenta, cyan, yellow and black toner images on the respective photoconductors 5Y, 5M, 5C, and 5K. At this time, a lubricant added to each toner particle is also supplied to the respective surfaces of the photoconductors 5Y, 5M, 5C, and 5K.

The recording paper P is fed from one of the sheet feeding cassettes 11 and 12 with the respective sheet separation and feed units 55 and 56. The recording paper P is fed to the image forming units 2Y, 2M, 2C, and 2K in synchronization with the pair of registration rollers 59 so that the color toner images formed on the photoconductors 5Y, 5M, 5C, and 5K are transferred onto a proper position of the recording paper P.

The recording paper P is positively charged with the paper attracting roller 58, and thereby the recording paper P is electrostatically attracted by the surface of the image transfer belt 31. The recording paper P is fed while the recording paper P is attracted by the image transfer belt 31, and the yellow, magenta, cyan, and black toner images are sequentially transferred onto the recording paper P, resulting in formation of a full color image in which the magenta, cyan, yellow and black toner images are overlaid. At this time, the lubricant added to each toner particle is also transferred onto the recording paper P. However, some amount of toner may not be transferred onto the recording paper P and adhere and remain on the respective surfaces of the photoconductors 5Y, 5M, 5C, and 5K.

The full color toner image on the recording paper P is fixed by the fixing unit 9 through the application of heat and pressure. The recording paper P having the fixed full color image is fed through a predetermined passage depending on image forming instructions. Specifically, the recording paper P is discharged to the sheet discharging tray 26 with an image side facing downward, or is discharged from the fixing unit 9 after passing through the reverse unit 8. Alternatively, when a duplex image forming operation is specified, the recording paper P is fed to the reverse transporting passage 54 and is switched back to be fed to the duplex print unit 7. Then another image is formed on the other side of the recording paper P by the image forming units 2Y, 2M, 2C, and 2K, and a duplex print copy having color images on both sides of the recording paper P is discharged. When a request of producing two or more copies is specified, the image forming operation described above is repeated.

After the toner image is transferred to the image transfer belt 31, the photoconductors 5Y, 5M, 5C, and 5K are separated from the image transfer belt 31. The photoconductors 5Y, 5M, 5C, and 5K then keep their rotations so that a brush roller 17*a* (see FIGS. 2 and 3) can apply lubricant scraped from a molded lubricant 17*b* (see FIGS. 2 and 3) onto the respective surfaces of the photoconductors 5Y, 5M, 5C, and 5K.

Further, the photoconductors 5Y, 5M, 5C, and 5K hold residual toner with the lubricant over the respective surfaces thereof. When removing the residual toner by using a cleaning blade 15*a* (see FIGS. 2 and 3), the cleaning blade 15*a* presses toner particles onto each surface of the photoconductors 5Y, 5M, 5C, and 5K. This causes the lubricant over the toner particles to form a thin layer over the respective surfaces of the photoconductors 5Y, 5M, 5C, and 5K. At this time, the lubricant supplied by the brush roller 17*a* onto the respective surfaces of the photoconductors 5Y, 5M, 5C, and 5K is also pressed and forms a thin layer over the respective surfaces of the photoconductors 5Y, 5M, 5C, and 5K.

Details of the lubricant and the related units will be described later.

The subsequent image forming operations will repeat the above-described image forming processes. Since the layer of the lubricant on each surface of the photoconductors 5Y, 5M, 5C, and 5K is thinly formed, the layer may not degrade the charging efficiency by the charging units 14Y, 14M, 14C, and 14K. A toner image newly formed on the respective surfaces of the photoconductors 5Y, 5M, 5C, and 5K may be transferred onto a transfer sheet conveyed by the image transfer belt 31 in a next image forming operation of the image forming apparatus 1.

Figure 2:
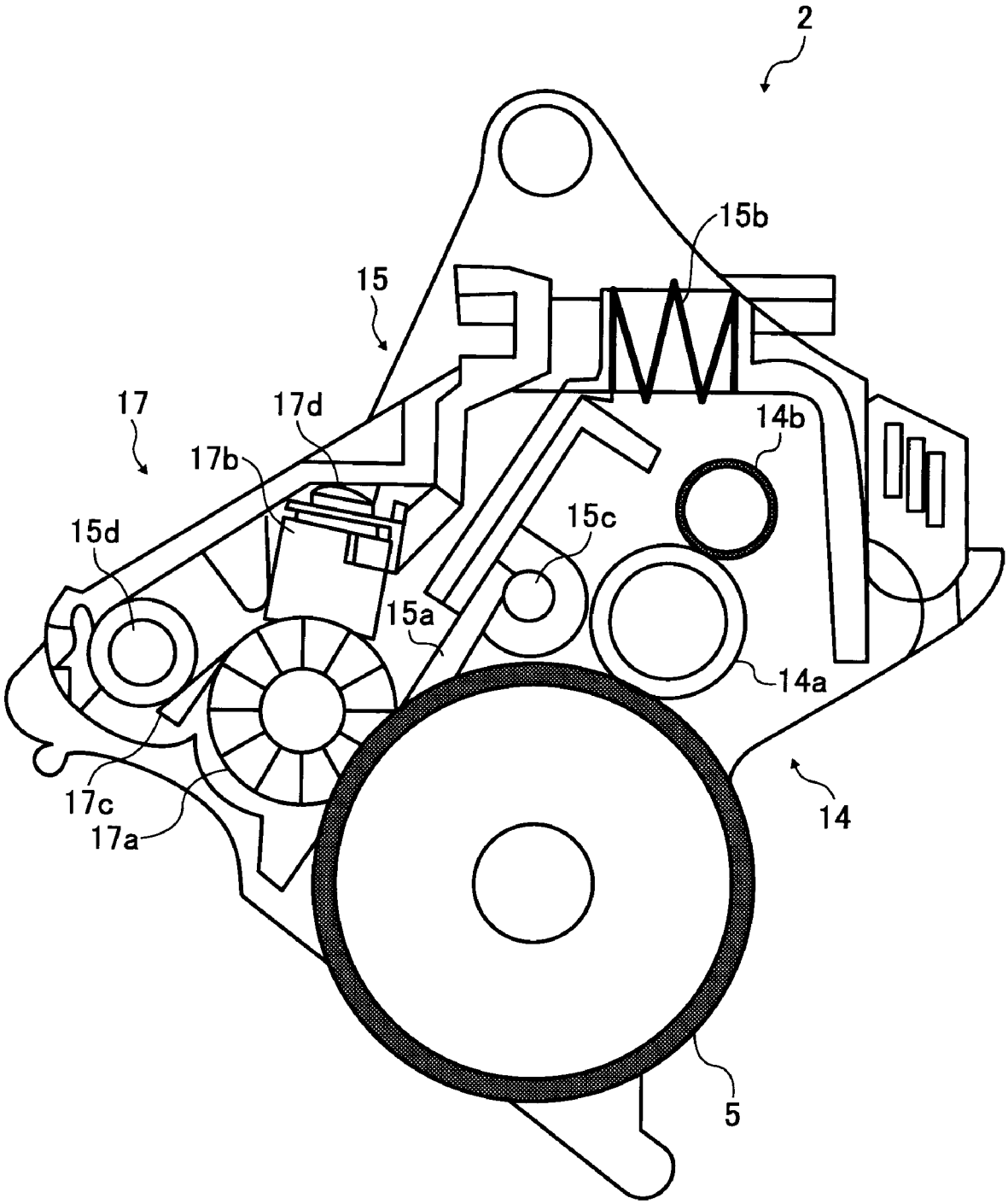
FIG. 2 is a schematic structure of an image forming unit and peripheral components for image forming of the image forming apparatus of FIG. 1.
Figure 3:
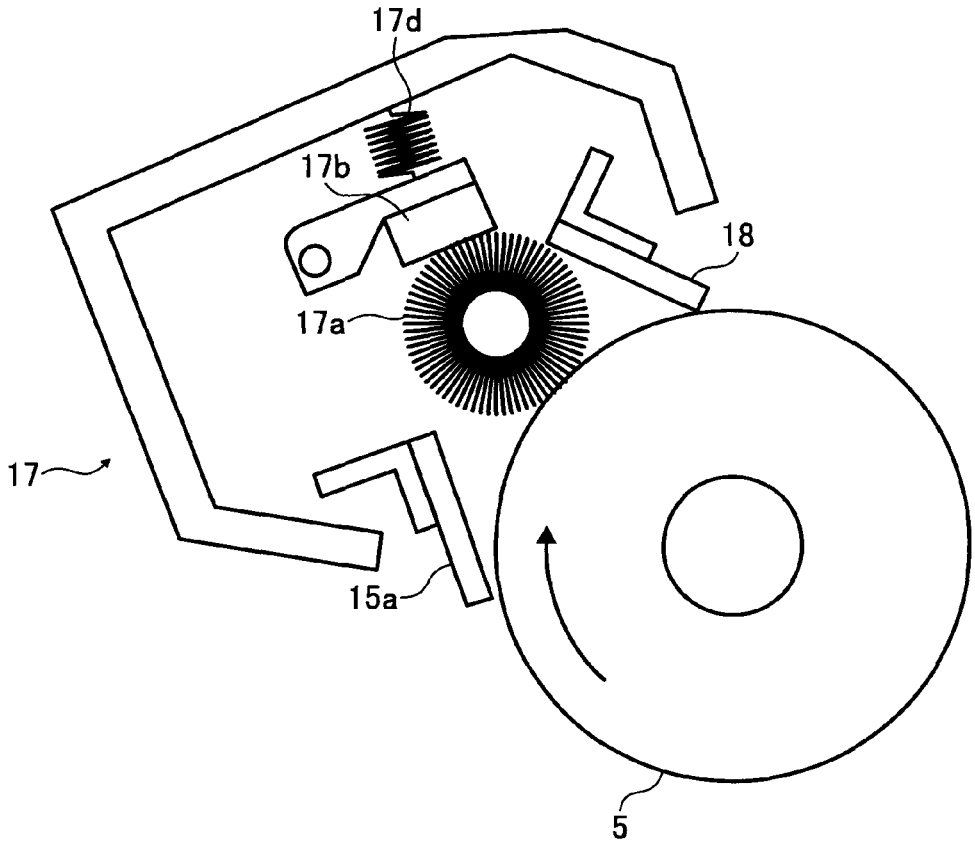
FIG. 3 is a schematic structure of a different image forming unit and peripheral components for image forming of the image forming apparatus of FIG. 1.

Referring to FIGS. 2 and 3, a configuration of one of the image forming units 2Y, 2M, 2C, and 2K is described. Each of the image forming units 2Y, 2M, 2C, and 2K has respective components around it. Since the image forming units 2Y, 2M, 2C, and 2K have similar structures and functions to each other, except that the toners contained therein are of different colors, the discussion below with respect to FIGS. 2 and 3 use reference numerals for specifying components of the full-color image forming apparatus 1 without suffixes indicative of colors such as "Y", "M", "C", and "K". In other words, the image forming unit 2 of FIG. 2, for example, can be any one of the image forming units 2Y, 2M, 2C, and 2K.

As shown in FIG. 2, the image forming unit 2 includes the photoconductor 5, the charging unit 14, a cleaning unit 15, a lubricating unit 17.

FIG. 3 shows a different example of the image forming unit 2 having a different layout of the image forming components. In addition, the image forming unit 2 of FIG. 3 includes a lubricant applying blade 18. However, the image forming unit 2 of FIG. 3 has similar functions to the image forming unit 2 of FIG. 2. Therefore, the following description is given in common for the image forming units 2 of FIGS. 2 and 3.

The charging unit 14 includes a charging roller 14*a* and a charging roller cleaning brush 14*b*. The charging roller 14*a* is conductive or semi-conductive. The charging roller 14*a* applies an alternating current voltage or a direct current voltage to charge the surface of the photoconductor 5. The charging roller cleaning brush 14*b* cleans the charging roller 14*a* while contacting the charging roller 14*a*.

The cleaning unit 15 includes the cleaning blade 15*a*, a blade pressure spring 15*b*, a blade supporting point 15*c*, and a toner collecting coil 15*d*. The cleaning blade 15*a* scrapes the photoconductor 5 to remove residual toner on the surface of the photoconductor 5. The scraped residual toner is conveyed by the brush roller 17*a* of the lubricating unit 17 toward a toner conveyance auger, not shown. The rotations of the toner conveyance auger further conveys the scraped toner to the toner storing unit 40 as shown in FIG. 1.

The lubricating unit 17 that serves as an application unit is provided in the image forming unit 2 and includes the brush roller 17*a*, the molded lubricant 17*b*, a brush roller scraper 17*c*, and a pressure spring 17*d*.

The brush roller 17*a* has a shape extending in an axial direction of the photoconductor 5 and is held in contact with the molded lubricant 17*b* to scrape lubricant therefrom and supply the scraped lubricant onto the surface of the photoconductor 5.

The molded lubricant 17*b* is a rectangular-parallelepiped member. The molded lubricant 17*b* is consumable, and the thickness thereof the molded lubricant 17*b* can reduce with age.

The brush roller scraper 17*c* scrapes and removes toner attaching to the brush roller 17*a*.

The pressure spring 17*d* presses the brush roller 17*a* at a given pressure against the molded lubricant 17*b* so that a substantially entire amount of the molded lubricant 17*b* can be consumed. Since the molded lubricant 17*b* is constantly pressed by the pressure spring 17*d* against the brush roller 17*a* as described above, the brush roller 17*a* can scrape lubricant from the molded lubricant 17*b*. Then, the lubricant scraped from the molded lubricant 17*b* can be applied to the surface of the photoconductor 5.

As described above, the image carrier in this example embodiment of the present invention is represented by the photoconductor 5. However, the image carrier is not limited to the photoconductor and can be a transfer belt.

Specific examples of the lubricant of the molded lubricant 17*b* are metal salts of fatty acids such as lead oleate, zinc oleate, copper oleate, zinc stearate, cobalt stearate, iron stearate, copper stearate, zinc palmitate, copper palmitate, and zinc linoleate; fluorine resin particles such as polytetrafluoroethylene, polychlorotrifluoroethylene, polyvinylidenefluoride, polytrifluorochloroethylene, polydichloro difluoroethylene, tetrafluoroethylene-ethylene copolymers, and tetrafluoroethylene-hexafluoropropylene copolymers. The metal salts of fatty acids are preferable to substantially reduce the friction coefficient of the photoconductor 5. Among these materials, zinc stearate and calcium or calcium stearate are more preferable.

By applying the lubricant onto the surface of the photoconductor 5, the thin layer of the lubricant can be formed on the surface of the photoconductor 5, and have a friction coefficient of equal to or less than 0.4. Preferably, the friction coefficient of the photoconductor 5 is equal to or less than 0.4, and more preferably is equal to or less than 0.2. By setting the friction coefficient equal to or less than 0.4, an interaction between the photoconductor 5 and the toner can be reduced, so that the toner remaining on the photoconductor 5 can easily be released to increase transferability.

In addition, a friction between the cleaning blade 15*a* and the photoconductor 5 can be controlled to increase cleaning efficiency. In particular, the toner having a high circularity is easily removed from the photoconductor 5 so that a cleaning failure can be reduced or prevented, where possible.

In addition, by increasing the transferability to reduce an amount of toner to be removed, the cleaning failure due to long-term usage of toner may be reduced or prevented, where possible. More preferably, the coefficient of friction of the toner is equal to or less than 0.2. Conversely, when the friction coefficient is below 0.1, the toner can easily slip between the cleaning blade 15*a* and the photoconductor 5, and the cleaning failure may occur such that the toner on the cleaning blade 15*a* passes by the cleaning blade 15*a* to the photoconductor 5.

The coefficient of static friction of the photoconductor 5 can be measured by Euler's method as described below.

Figure 4:
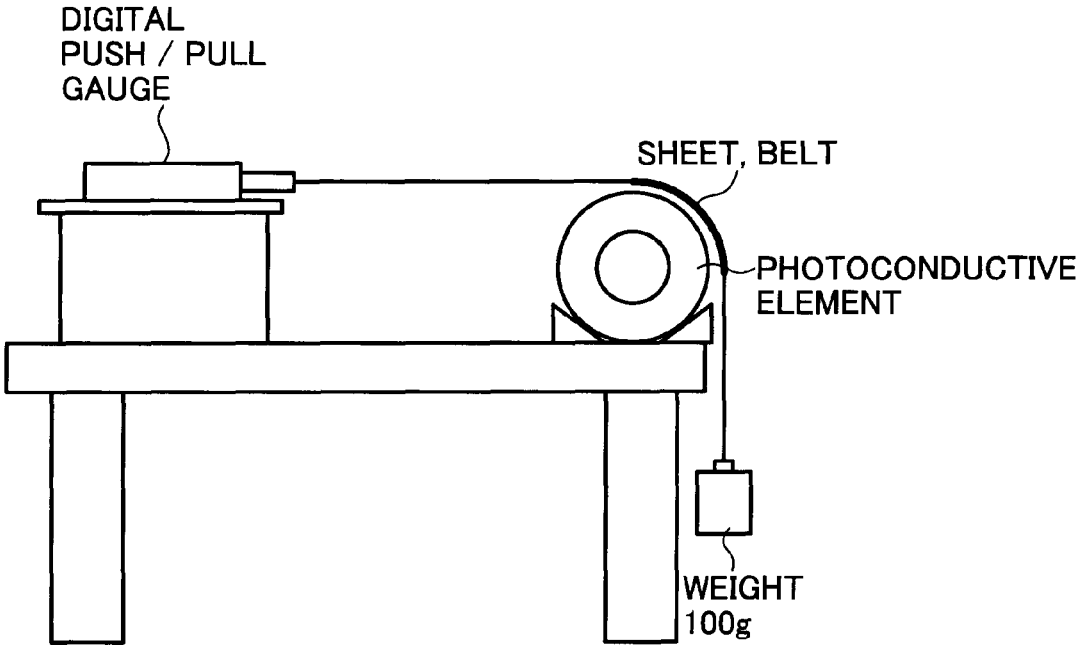
FIG. 4 is a side elevation view showing measurement of a friction coefficient of a photoconductor of the image forming apparatus.

FIG. 4 is a side elevation view showing measurement of the coefficient of static friction of the photoconductor 5. In this case, a good quality paper of medium thickness is stretched as a belt over one fourth of a circumference of the photoconductor 5 longitudinally in the direction of pulling. Both ends in a pulling direction of the good quality paper are provided with strings as a member supporting the paper. A weight of 0.98 N (100 gram), for example, is suspended from one side of the belt. A force gauge installed on the other end is pulled. And, a load at a timing when the belt is moved is read out to be substituted in a following relation:

$\mu s = 2/\pi \times 1n(F/0.98)$, where "μs" is a coefficient of static friction, and where "F" is a measured value.

The friction coefficient of the photoconductor 5 of the image forming apparatus 1 is set to a value that is set when the rotation becomes stable due to the image forming. Since the friction coefficient of the photoconductor 5 is affected by other units disposed in the image forming apparatus 1, the value depends on a friction coefficient obtained immediately after the image forming is completed. However, the value of the friction coefficient may substantially become stable after 1,000 copies of A4-size recording sheets are printed. Therefore, a friction coefficient described here is determined to be a friction coefficient obtained in a stable condition.

A detailed description is now given of the above-described lubricating unit 17 in reference to FIGS. 2 and 3.

As previously described, examples of the lubricant of the molded lubricant 17*b* provided in the lubricating unit 17 includes metal salts of fatty acid such as zinc stearate, fluorine resin particles such as polytetrafluoroethylene, and so forth. One of the examples of the lubricant is made by melting and solidificating metal salts of fatty acid such as zinc stearate and processing into the shape of a rod. In a different example, the lubricant is made by processing fluorine resin particles such as polytetrafluoroethylene into the shape of a rod of a sheet.

The above-described molded lubricant 17*b* is fixed to a supporting member, not shown, to press contact against the brush roller 17*a*. A spring member may adjust an amount of applying the lubricant to apply onto the surface of the photoconductor 5. This can provide a longer life to the lubricant.

Examples of the brush roller 17*a* are resins such as styrene resin, acrylic resin, ester resin, fluorine contained resin, amide resin, PET (polyethylene terephthalate) resin, etc. It is preferable to use the amide resin or the PET resin. The amide resin is abrasion-resistant and has high intensity and the PET resin has less permanent deformation and has a fibrous member standing less obliquely.

The brush roller 17*a* may include a conductive powder. Examples of the conductive powder include carbon black such as acetylene black and furnace black, black lead, or metallic powders such as copper, silver, etc. At this time, the fibrous members of the brush roller 17*a* are conductive or semi-conductive, and the electrical resistance of the brush roller 17*a* is in a range of from $10^2$ Ω·cm to $10^8$ Ω·cm. An insulating brush cannot apply a bias. Further, when the brush roller 17*a* is charged by slidably contacting the photoconductor 5 or the toner, the charge may not be attenuated or damped. To avoid the charge over the brush roller 17*a*, it is preferable the brush roller 17*a* is grounded. Alternatively, a charge bias including an AC voltage superimposed on a DC voltage can be applied to the brush roller 17*a*.

As previously described, the pressure spring presses the molded lubricant 17*b* toward the brush roller 17*a*. As the force of the pressure spring for pressing the molded lubricant 17*b* increases, the amount of lubricant scraped from the molded lubricant 17*b* by the brush roller 17*a* may increase, that is, the amount of scraped lubricant supplied to the surface of the photoconductor 5 may increase, thereby reducing the coefficient of friction of the photoconductor 5.

Referring now to FIGS. 5A, 5B, 5C, 5D, 5E, 5F, 5G, and 5H, respective cross-sectional shapes of various fibrous members are described.

Figure 5A:
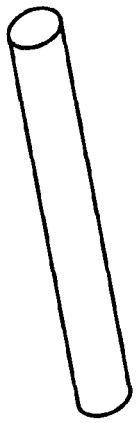
FIGS. 5A through 5H are cross-sectional views of various fibrous members mounted on a brush roller used in the image forming apparatus.
Figure 5B:
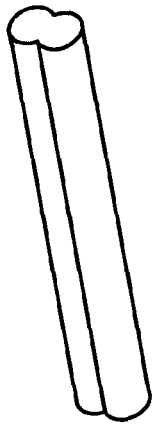
Figure 5C:
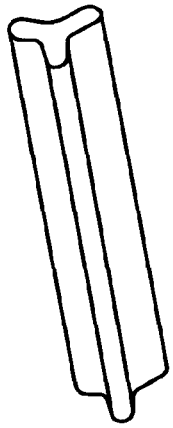
Figure 5D:
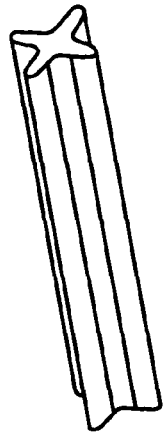
Figure 5E:
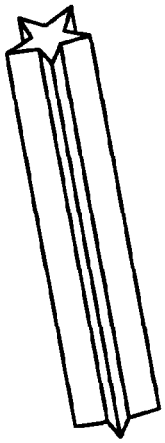
Figure 5F:
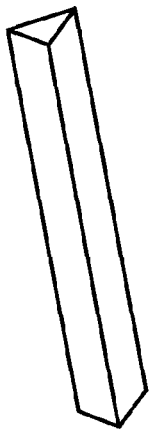
Figure 5G:
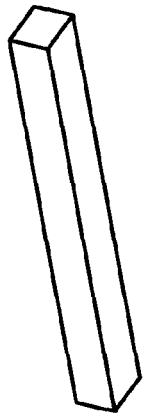
Figure 5H:
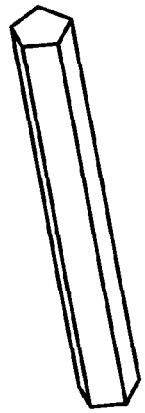

A known brush roller includes a cross-section fiber having a round shape, which is a known shape. The brush roller 17*a* according to one exemplary embodiment of the present invention may include a modified cross-section fiber having a bilobed shape as shown in FIG. 5B, a modified cross-section fiber having a trilobed shape as shown in FIG. 5C, a modified cross-section fiber having a cross shape as shown in FIG. 5D, a modified cross-section fiber having a star shape as shown in FIG. 5E, a modified cross-section fiber having a triangular shape as shown in FIG. 5F, a modified cross-section fiber having a square shape as shown in FIG. 5G, a pentagonal shape as shown in FIG. 5H, and other modified cross-section fibers having different polygonal shapes. When compared to the known brush roller with the fibrous member having a round-shaped cross-section fiber shown in FIG. 5A, the brush roller 17*a* with the fibrous member having any one of the above-described shapes shown in FIGS. 5B through 5H has a greater force with which to slidably move on the surface of the molded lubricant 17*b*, thus increasing the amount of lubricant scraped from the molded lubricant 17*b* may increase. Therefore, the load of the pressure spring to press the molded lubricant 17*b* against the brush roller 17*a* can remain relatively small. With the relatively small load of the pressure spring of the molded lubricant 17*b*, the bite of the brush roller 17*a* into the molded lubricant 17*b* can be kept small. Therefore, the image forming apparatus 1 according to an exemplary embodiment of the present invention can reduce the extent of increase in rotational load of the brush roller 17*a* due to the elastic member as well as reduce decreases in working life of each drive member or unit of the brush roller 17*a*, increases in motor costs and power consumption due to increased motor torque, and frequency of occurrence of banding due to rotation vibration of the brush roller 17*a*.

Referring now to FIGS. 6, 7A, 7B, and 7C, schematic configurations of the brush roller 17*a* of the image forming apparatus 1 according to an exemplary embodiment of the present invention are described.

Figure 6:
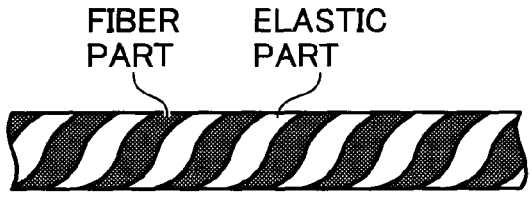
FIG. 6 is a schematic diagram of a brush roller used in the image forming apparatus.
Figure 7A:
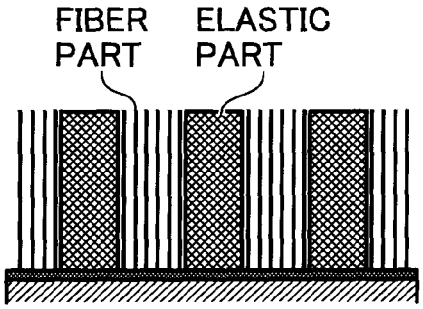
FIGS. 7A, 7B, and 7C are schematic diagrams of various types of the brush roller having a fiber part and an elastic part.
Figure 7B:
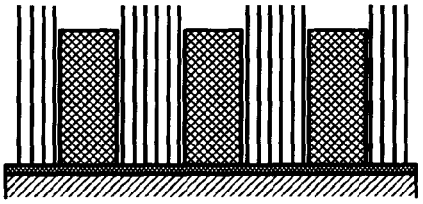
Figure 7C:
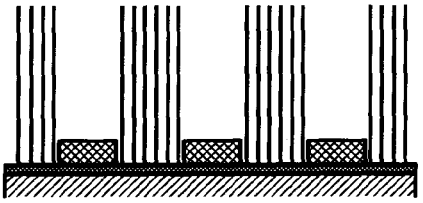

FIG. 6 shows an external view of the brush roller 17*a* and FIGS. 7A, 7B, and 7C show schematic cross-sectional views of the brush roller 17*a*.

As previously described, the brush roller 17*a* includes the fibrous members each having a modified cross-sectional shape. Examples of the modified cross-sectional shape are a bilobed shape, a trilobed shape, a cross shape, a star shape, a triangular shape, a square shape, a pentagonal shape, and other polygonal shapes. Sharp angles and lines of the leading edge and sides of the fibrous members having such a modified cross-sectional shape slidably move over and scrape the surface of the molded lubricant 17*b*. Therefore, when compared with known fibrous members having a round cross-sectional shape, for example, the above-described fibrous members mounted on the brush roller 17*a* can increase an amount of lubricant to scrape from solid lubricant or molded lubricant 17*b*.

To form modified cross-section fibers as shown in FIGS. 5B through 5H, an injection method is used in a manufacturing step to inject a fiber material from holes each having a desired cross-sectional shape. A description of controls of manufacturing the cross-section fiber is omitted because the controls are generally known.

As shown in FIGS. 6, 7A, 7B, and 7C, the brush roller 17*a* includes a fiber part with fine fibrous members, each having a modified cross-sectional shape, and an elastic part with an elastic member having a diameter thicker than a diameter of a fine fibrous member. The fine fibrous members are mounted on the brush roller 17*a* in a high density, and can effectively scrape a sufficient amount of lubricant from the molded lubricant 17*b* and apply the scraped lubricant to the surface of the photoconductor 5 uniformly. The elastic members are also mounted on the brush roller 17*a*. The elastic members can withstand the inroad of the molded lubricant 17*b* with respect to the brush roller 17*a*, thereby preventing the fine fibrous members from obliquely standing to the surface of the brush roller 17*a* with age. It is preferable that the elastic members include resin foam such as polyurethane and so forth that has appropriate flexibility.

The elastic members can be disposed as shown in FIGS. 7B and 7C. That is, various alignments of the fiber part with the fine fibrous members and the elastic part with the elastic members on the brush roller 17*a* can be applied. Specifically, the height of the elastic members from the surface of the cored bar of the brush roller 17*a* can be adjusted to lower than the height of the fine fibrous members therefrom. Accordingly, the above-described alignments of the elastic members with respect to the fine fibrous members can reduce the extent of the increase of the rotational load of the brush roller due to the contact load of the elastic member, the decrease in working life of each drive member or unit of the brush roller 17*a*, the increases of motor costs and power consumptions due to an increase of a motor torque, and the frequency of occurrence of banding due to rotation vibration of the brush roller 17*a*.

As shown in the process unit 2 in FIG. 3, the lubricant applying blade 18 may be disposed at a downstream side of the brush roller 17*a* in a rotation direction of the photoconductor 5. A pressure force exerted by an edge of the lubricant applying blade 18 can form a layer of the scraped lubricant more stably.

Further, the brush roller 17*a* may rotate with the photoconductor 5 at a contact position at which the brush roller 17*a* and the photoconductor 5 contact. The rotation of the brush roller 17*a* in a same travel direction of the photoconductor 5 at the contact position can cause the brush roller 17*a* to supply the scraped lubricant held by the fibrous members of the brush roller 17*a* to the surface of the photoconductor 5 without imparting any mechanical impact or shock to the photoconductor 5. When the brush roller 17*a* applies the scraped lubricant to the surface of the photoconductor 5, the scraped lubricant may not need to form a layer, because the layer of the scraped lubricant can be formed when the cleaning blade 15*a* presses the photoconductor 5. Therefore, it is preferable that the brush roller 17*a* and the photoconductor 5 rotate in the same direction at the contact position.

Further, a ratio of a circumferential velocity of the photoconductor 5 to a circumferential velocity of the brush roller 17*a* is preferably in a range of from approximately 0.8:1 to approximately 1.2:1.

When the ratio of the circumferential velocity of the photoconductor 5 to a circumferential velocity of the brush roller 17*a* is less than 0.8:1, the amount of lubricant to be applied to the photoconductor 5 may be smaller than a given amount of lubricant for the photoconductor 5.

By contrast, when the ratio of the circumferential velocity of the photoconductor 5 to a circumferential velocity of the brush roller 17*a* is greater than 1.2:1, a mechanical impact or shock may be applied that is sufficient to damage the photoconductor 5, thereby shortening the life of the photoconductor 5.

Therefore, it is preferable that the ratio of the circumferential velocity of the photoconductor 5 to the circumferential velocity of the brush roller 17*a* is in a range of from approximately 0.8:1 to approximately 1.2:1. Further, it is more preferable that the ratio of the circumferential velocity of the photoconductor 5 to the circumferential velocity of the brush roller 17*a* is in a range of from approximately 1.0:1 to approximately 1.1:1 so that the scraped lubricant can be applied to the photoconductor 5 with less impact.

To apply lubricant uniformly to a photoconductor, a higher concentration of the fibrous members on a brush roller is preferable. It is known, however, that achieving a high concentration of the fibrous members depends on the capabilities of the weaving machine. In addition, even when a high concentration of non-fine fibrous members can be achieved within the capabilities of the weaving machine, the rotational load of the brush roller may increase thereby, thus further shortening the working life of each drive unit or member, further increasing electrical power consumption due to increase in motor torque, and further increasing a frequency of banding due to vibration of the rotation of the brush roller.

To eliminate the above-described disadvantages and obtain a sufficient amount of lubricant from a solid lubricant, known fibrous members, each having a round-shaped cross-section fiber, generally include a diameter in a range of from 6 T to 15 T and a concentration thereof in a range of from 20,000 fibers/inch$^2$ to 50,000 fibers/inch$^2$.

As previously described, when the brush roller includes fibrous members each having a modified cross-sectional shape, the amount of lubricant scraped from the solid lubricant may increase. Accordingly, fine fibrous members can scrape a sufficient amount of lubricant from solid lubricant.

Figure 8:
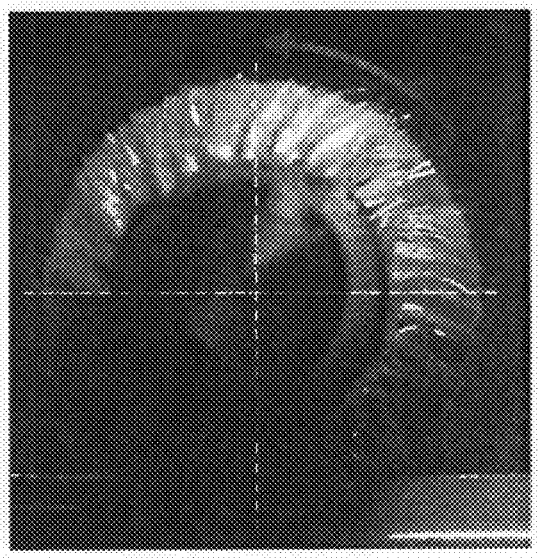
FIG. 8 is a side view of the brush roller with slanted fibrous members after a reproduction of 4,000 copies.

The inventors of the present invention have performed a test with a brush roller with fibrous members. The fibrous members used for the test, each having a thickness of 3.3 T, had a concentration of 150,000 fibers/inch$^2$. The inventors found that the brush roller having the above-described concentration and thickness of fibrous members held an amount of lubricant 1.5 to 2.0 times greater than a regular or reference brush roller. However, when the brush roller used for the test was evaluated after some thousands of copies were reproduced, the amount of lubricant held by the above-described brush roller was found to be reduced to substantially the same amount of lubricant held by the regular or reference brush roller. After the above-described reproducing operation, the fibrous members of the above-described brush roller were slanted or angled from the root part as shown in FIG. 8. Accordingly, the inventors found fine fibrous members were easy to slant with respect to the cored bar of the brush roller, consequently decreasing the amount of lubricant scraped from the solid lubricant with age.

To eliminate the disadvantages according to the above-described test results, the image forming apparatus 1 according to an exemplary embodiment of the present invention includes the lubricating unit 17 having the brush roller 17*a* with the fiber part and the elastic part as shown in FIGS. 6, 7A, 7B, and 7C. The fiber part of the brush roller 17*a* includes the fine fibrous members each having a thickness of from approximately 1.5 T to approximately 4.0 T. The elastic part includes the elastic members, and the outer diameter of each elastic member is smaller than the outer diameter of each fine fibrous member. With the above-described configuration of the brush roller 17*a* having the elastic member between the fine fibrous members at given intervals, the fine fibrous members having a modified cross-sectional shape can continuously stand perpendicular to the cored bar of the brush roller 17*a* and constantly maintain a given amount of lubricant scraped from the molded lubricant 17*b*.

Further, the length of the elastic member is shorter than the length of the fibrous member. Therefore, the image forming apparatus 1 can reduce the extent of an increase of the rotational load of the brush roller 17*a* due to the elastic member, a decrease in working life of each drive member or unit of the brush roller 17*a*, an increase in motor costs and power consumption due to an increase in motor torque, and frequency of occurrence of banding due to rotation vibration of the brush roller 17*a*.

The elastic part with the elastic member and the fiber part with the fibrous members of the brush roller 17*a* are manufactured separately into a reed shape through a same method as a known brush. The elastic part and the fiber part in a reed shape are wrapped alternatively around the cored bar of the brush roller 17*a* as shown in FIG. 6.

Figure 9A:
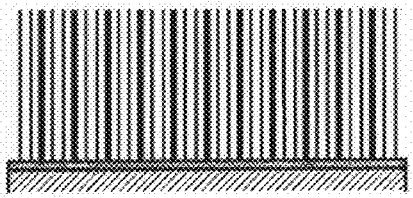
FIGS. 9A, 9B, and 9C are schematic diagrams of various types of the brush roller having different thicknesses.
Figure 9B:
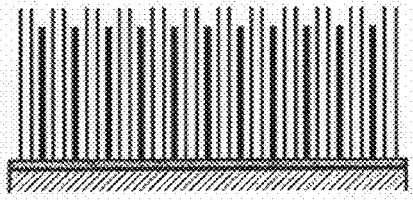
Figure 9C:
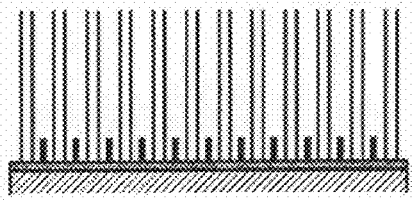

Referring now to FIGS. 9A, 9B, and 9C, different configurations of the brush roller 17*a* used for the image forming apparatus 1 according to an exemplary embodiment of the present invention are described.

In the brush roller 17*a* shown in FIGS. 9A, 9B, and 9C include at least two fiber parts having different fibrous members of different thicknesses. Among the at least two fiber parts, the fibrous members of fine fibers have a thickness in a range of from approximately 1.5 T to approximately 4 T. In addition, the fibrous members of thick fibers may have a length from the cored bar of the brush roller 17*a* shorter than the fibrous members of fine fibers, as shown in FIGS. 9B and 9C.

Since the brush roller 17*a* in FIGS. 9A, 9B, and 9C includes the fibrous members of fine fibers and the fibrous members of thick fibers together, when the fine fibrous members include modified cross-section fibers, the fibrous members can continuously stand on the brush roller 17*a* perpendicular to the cored bar of the brush roller 17*a* without slanting and can stably maintain a given amount of lubricant scraped from the solid or molded lubricant 17*b*.

Further, since the length of the fibrous members of thick fibers is shorter than the length of the fibrous members of fine fibers, the above-described alignments of the fibrous members can reduce the extent of the increase of the rotational load of the brush roller due to the fibrous member of thick fiber, the decrease in working life of each drive member or unit of the brush roller 17*a*, the increase in motor costs and power consumption due to an increase of a motor torque, and the frequency of occurrence of banding due to rotation vibration of the brush roller 17*a*.

The toner of the present invention includes at least a binder resin and a colorant. The lubricant scraped from the molded lubricant 17 may be added to the surface of the toner to reduce friction. In addition, the toner of the present invention may optionally include a charge controlling agent for controlling charging ability of the toner, a release agent for increasing a releasing ability of the toner with respect to the fixing unit 9, and an external additive for enhancing fluidity of the toner.

(Binder Resin)

Suitable binder resins for use in the toner of the present invention include ester resins, vinyl resins, amide resins, epoxy resins, silicone resins, etc. These resins can be used alone or in combination. Of these resins, preferably vinyl resins are used.

Specific examples of the binder resins include styrene polymers and substituted styrene polymers such as polystyrene, poly-p-chlorostyrene and polyvinyltoluene; and styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-acrylonitrile copolymers, styrene-vinyl methyl ether copolymers, styrene-butadiene copolymers, styrene-methyl methacrylate-butyl acrylate copolymers, etc.

(Colorant)

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, 25 Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LitholFast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A content of the colorant in the toner is preferably from 1% to 15% by weight, and more preferably from 3% to 10% by weight, based on total weight of the toner.

(Charge Controlling Agent)

Suitable charge controlling agents for use in the toner of the present invention include compounds including salicylic acid, Nigrosine dyes, compounds including quaternary ammonium salts, compounds including alkylpyridinium, etc. The contained amount of such charge controlling agent with respect to the toner is generally in a range of from 0.1% to 5%, preferably in a range of from 1% to 3%.

(Release Agent)

Suitable release agents for use in the toner of the present invention include polyolefin waxes such as low-molecular-weight polyethylene, low-molecular-weight polypropylene, copolymers of low-molecular-weight polyethylene and low-molecular-weight polypropylene, etc.; ester waxes such as lower alcohol fatty acid ester, higher alcohol fatty acid ester, polyol fatty acid ester, etc.; amide wax, and etc. The contained amount of such release agent with respect to the toner is generally in a range of from 0.5% to 10%, preferably in a range of from 1% to 5%.

Preferably, the toner particle has an average circularity of from approximately 0.92 to approximately 1.00.

The circularity is defined by the following equation 1:

Circularity SR of a particle=(circumference of circle identical in area with the projected grain image of the particle/circumference of the projected grain image) Equation 1.

As the shape of a toner particle is close to a truly spherical shape, the value of circularity becomes close to 1.00. The toner having a high circularity is easily influenced by a line of electric force when the toner is present on a carrier or a developing sleeve used for an electrostatic developing method, and an electrostatic latent image formed on the surface of the photoconductive element 1 is faithfully developed by the toner along the line of electric force thereof.

When such toner is used in a known image forming apparatus, even if the cleaning blade 15*a* or other cleaning member contacts or is abut against the photoconductor 5, the toner cannot be sufficiently removed. The insufficient removal of the toner may occur because the toner having a substantially spherical shape easily moves on the surface of the photoconductor 5.

To prevent the occurrence of the above-described condition, a force greater than a given force of the cleaning blade 15*a* or other cleaning member when contacting the surface of the photoconductor 5 is applied to the cleaning blade 15*a* so that the cleaning blade 15*a* or other cleaning member with the greater force can abut against the photoconductor 5 to effectively scrape the residual toner on the surface of the photoconductor 5. The greater force, however, may adversely affect the rotation speed or accuracy of travel of the photoconductor 5, resulting in a banding.

By contrast, in an exemplary embodiment of the present invention, both the lubricating unit 17 and the toner may apply lubricant onto the surface of the photoconductor 5 to reduce the coefficient of friction on the surface of the photoconductor 5. With the above-described action, the transferability of toner during the transfer operation may be enhanced, that is, a greater amount of toner can be transferred onto a recording medium or an intermediate transfer member. The above-described increase of transfer amount of toner can reduce the residual toner on the surface of the photoconductor 5 and the load of the cleaning blade 15*a*. At the same time, the residual toner can be reduced from the surface of the photoconductor 5 without causing a banding when the cleaning blade 15*a* abuts against the surface of the photoconductor 5 with the greater force.

A circularity of a dry toner manufactured by a dry pulverization method is thermally or mechanically controlled to be within the above-described range. For example, a thermal method in which dry toner particles are sprayed with an atomizer together with hot air can be used for preparing a toner having a spherical form. That is a thermal process of ensphering the toner particle. Alternatively, a mechanical method in which a spherical toner can be prepared by agitating, dry toner particles in a mixer such as a ball mill, with a medium such as a glass having a low specific gravity can be used. However, aggregated toner particles having a large particle diameter are formed by the thermal method or fine powders are produced by the mechanical method. Therefore, it is necessary to subject the residual toner particles to a classifying treatment. If a toner is produced in an aqueous medium, the shape of the toner can be controlled by controlling the degree of agitation in the solvent removing step.

Further, a fluidizing agent can be added to the toner.

Examples of the fluidizing agent are fine particles of metallic oxide such as silica, titania, alumina, magnesia, zirconia, ferrite, magnetite, etc., and fine particles of metallic oxide processed by silane coupling agent, titanate coupling agent, or zircon-aluminate. It is preferable to use silica or titania that is hydrophobized by the above-described coupling agents. Silica including a primary particle with a small diameter thereof can contribute to an increase of fluidity of toner. Titania can control a charge amount of toner. It is more preferable to use silica and titania in combination.

Further, an amount of lubricant added to the surface of a toner particle is preferably in a range of from approximately 0.1% to approximately 2.0%.

The amount of lubricant below 0.1% is insufficient to supply to the surface of the photoconductor 5, and it is difficult to reduce the coefficient of friction of the photoconductor 5.

In addition, the amount of lubricant above 2.0% can cause the toner held on the photoconductor 5 to adhere to the charge roller 14*a*, resulting in a production of defect images.

In general, the smaller volume-based average particle diameter Dv the toner has, the better thin line reproducibility the toner has. Therefore, it is preferable the toner has the volume-based average particle diameter Dv of less than 8 μm. However, the smaller volume-based average particle diameter the toner has, the worse developing and cleaning properties the toner has. Therefore, it is preferable the toner has the volume-based average particle diameter Dv of greater than 3 μm.

When the toner has the volume-based average particle diameter Dv of less than 3 μm, a greater amount of very fine toner particles, which are difficult to be developed, are held on the respective surface of the carriers or on the surface of the developing roller. Therefore, the toner other than toner including the very fine toner particles cannot sufficiently contact or rub the carrier or the developing roller. The above-described insufficient contact can increase an amount of the reversely charged toner, resulting in a production of defect image such as an image having fogging on the background area. Accordingly, it is preferable that the toner has the volume-based average particle diameter Dv of greater than 3 μm.

Particle diameter distribution of toner indicated based on a ratio of the volume-based average particle diameter Dv to a number-based average particle diameter Dn is preferable to be in a range from approximately 1.05 to approximately 1.40. A sharp control of the distribution of the toner particle diameters, the distribution of the toner charge can be uniform. When the ratio Dv/Dn is greater than 1.40, the amount of the irregular charge toner becomes large and it becomes hard to produce an image having high resolution and high quality. A toner particle having the ratio Dv/Dn less than 1.05 is difficult to produce and is impractical to use. The above-described particle diameter of toner can be measured by, for example, a Coultar counter method using a measuring instrument for measuring particle diameter distribution of toner, such as, Coultar counter multisizer (manufactured by Coulter Electronics Limited). By using the above-described measuring instrument, the particle diameter of toner may be obtained with a 50 μm aperture, by measuring the average of particle diameters of 50,000 toner particles.

It is preferable that a shape factor "SF-1" of the toner used in each of the developing units 10Y, 10M, 10C, and 10K is in a range of from approximately 100 to approximately 180, and the shape factor "SF-2" of the toner used in each of the developing units 10Y, 10M, 10C, and 10K is in a range of from approximately 100 to approximately 180.

Figure 10A:
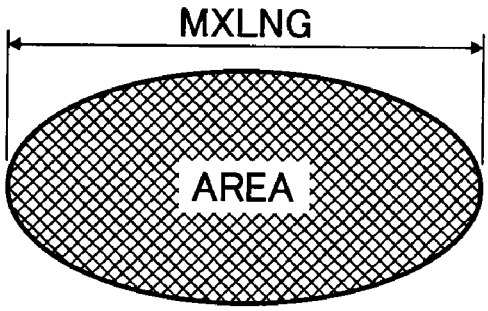
FIG. 10A is a drawing of a toner having an "SF-1" shape factor.

Referring to FIG. 10A, the shape factor "SF-1" is a parameter representing the roundness of a particle. The shape factor "SF-1" of a particle is calculated by a following Equation 1:

$$\text{SF-1}=\{(MXLNG)^2/\text{AREA}\}\times(100\pi/4) \qquad \text{Equation 1,}$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF-1" is 100, the particle has a perfect spherical shape. As the value of the "SF-1" increases, the shape of the particle becomes more elliptical.

Figure 10B:
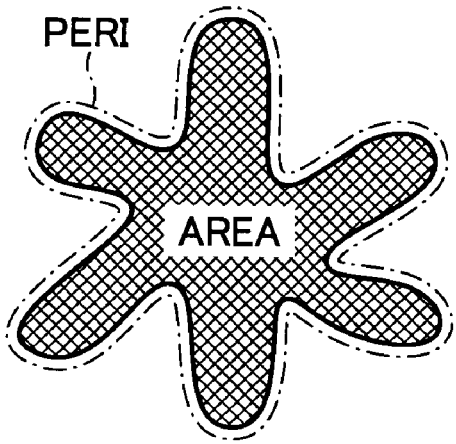
FIG. 10B is a drawing of a toner having an "SF-2" shape factor.

Referring to FIG. 10B, the shape factor "SF-2" is a value representing irregularity (i.e., a ratio of convex and concave portions) of the shape of the toner. The shape factor "SF-2" of a particle is calculated by a following Equation 2:

$$\text{SF-2}=\{(PERI)^2/\text{AREA}\}\times(100\pi/4) \qquad \text{Equation 2,}$$

where "PERI" represents the perimeter of a figure obtained by projecting a toner particle on a two dimensional plane.

When the value of the shape factor "SF-2" is 100, the surface of the toner is even (i.e., no convex and concave portions). As the value of the "SF-2" increases, the surface of the toner becomes uneven (i.e., the number of convex and concave portions increase).

In this embodiment, toner images are sampled by using a field emission type scanning electron microscope (FE-SEM) S-800 manufactured by HITACHI, LTD. The toner image information is analyzed by using an image analyzer (LUSEX3) manufactured by NIREKO, LTD.

As the toner shape becomes spherical, a toner particle becomes held in point-contact with another toner particle or the photoconductor 5. Under the above-described condition, the toner adhesion force between two toner particles may decrease, resulting in the increase in toner fluidity, and the toner adhesion force between the toner particle and the photoconductor 5 may decrease, resulting in the increase in toner transferability. And, the toner storing unit 40 may easily collect reversely charge toner.

Further, considering collecting performance, it is preferable that the values of the shape factors "SF-1" and "SF-2" are 100 or greater. As the values of the shape factors "SF-1" and "SF-2" become greater, the toner charge distribution becomes greater and a load to the toner storing unit 40 becomes greater. Therefore, the values of the shape factors "SF-1" and "SF-2" are preferable to be less than 180.

Figure 11A:
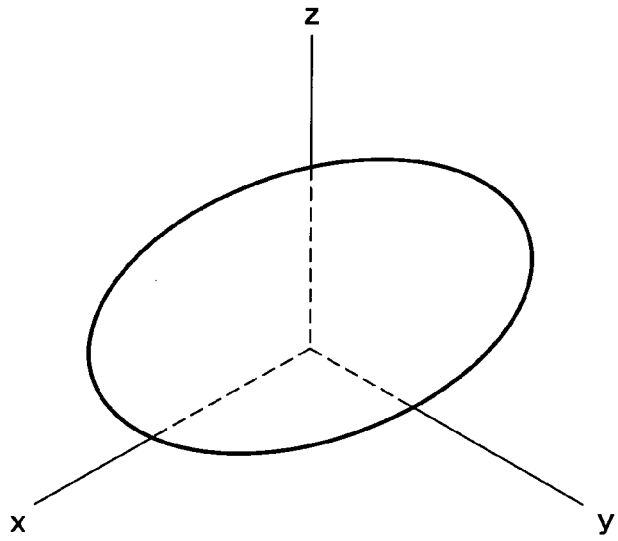
FIG. 11A is an outer shape of a toner used in the image forming apparatus of FIG. 1.
Figure 11B:
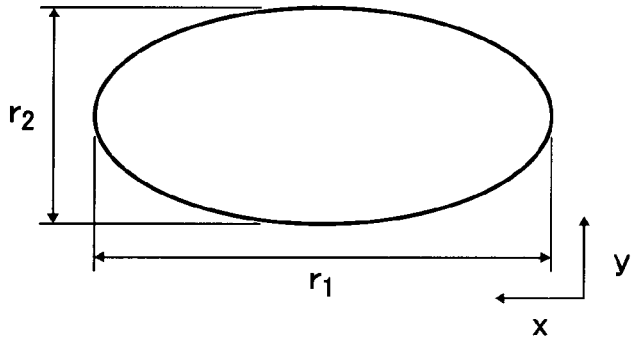
FIGS. 11B and 11C are schematic cross-sectional views of the toner, showing major and minor axes and a thickness of FIG. 11A.
Figure 11C:
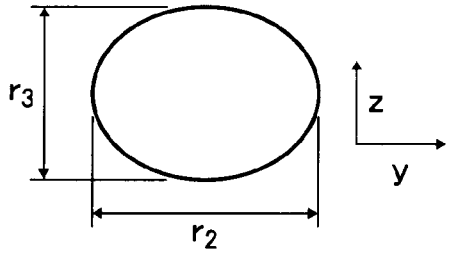

Further, the toner used in the image forming apparatus 1 may be substantially spherical. Referring to FIGS. 11A, 11B, and 11C, sized of the toner is described. An axis "x" of FIG. 11A represents a major axis "r1" of FIG. 11B, which is the longest axis of the toner. An axis "y" of FIG. 11A represents a minor axis "r2" of FIG. 11B, which is the second longest axis of the toner. The axis "z" of FIG. 11A represents a thickness "r3" of FIG. 11B, which is a thickness of the shortest axis of the toner. The toner has a relationship between the major and minor axes "r1" and "r2" and the thickness "r3" as follows:

$$r1 \geqq r2 \geqq r3.$$

The toner of FIG. 11A is preferably in a spindle shape in which the ratio (r2/r1) of the major axis "r1" to the minor axis "r2" is approximately 0.5 to approximately 1.0, and the ratio (r3/r2) of the thickness "r3" to the minor axis "r2" is approximately 0.7 to approximately 1.0.

When the ratio (r2/r1) is less than approximately 0.5, the toner has an irregular particle shape, and the value of the toner charge distribution increases.

When the ratio (r3/r2) is less than approximately 0.7, the toner has an irregular particle shape, and the value of the toner charge distribution increases. When the ratio (r3/r2) is approximately 1.0, the toner has a substantially round shape, and the value of the toner charge distribution decreases.

The lengths showing with "r1", "r2" and "r3" can be monitored and measured with scanning electron microscope (SEM) by taking pictures from different angles.

The shape of toner depends on the manufacturing method used. For example, a toner particle produced by a dry type grinding method has an irregular shape with an uneven surface. The irregular-shaped toner, however, can be modified to an approximately round toner by being subjected to a mechanical treatment or a thermal treatment. Toner produced by a method such as a suspension polymerization method and an emulsion polymerization method may have a smooth surface and a perfectly spherical form. In this regard, spherical form can be charged to elliptic form by performing agitating in a middle of reaction, i.e., applying a shearing force to the toner.

A toner having a substantially spherical shape is preferably prepared by a method in which a toner composition including a polyester prepolymer having a function group including a nitrogen atom, a polyester, a colorant, and a releasing agent is subjected to an elongation reaction and/or a crosslinking reaction in an aqueous medium in the presence of fine resin particles. Since thus prepared toner has a hardened surface, the toner has a good hot offset resistance. Therefore, toner hardly causes a problem in that toner particles adhere to the fixing unit 30, which would resulting in degradation in the resultant copy image.

Toner constituents and preferable manufacturing method of the toner of the prevent invention will be described below.

(Polyester)

Polyester is produced by the condensation polymerization reaction of a polyhydric alcohol compound with a polyhydric carboxylic acid compound.

As the polyhydric alcohol compound (PO), dihydric alcohol (DIO) and polyhydric alcohol (TO) higher than trihydric alcohol can be used. In particular, a dihydric alcohol DIO alone or a mixture of a dihydric alcohol DIO with a small amount of polyhydric alcohol (TO) is preferably used. Specific examples of the dihydric alcohol (DIO) include alkylene glycol such as ethylene glycol, 1,2-propylene glycol, 1,3-propylene glycol, 1,4-butanediol, 1,6-hexanediol; alkylene ether glycol such as diethylene glycol, triethylene glycol, dipropylene glycol, polyethylene glycol, polypropylene glycol, polytetramethylene ether glycol; alicyclic diol such as 1,4-cyclohexane dimethanol, hydrogenated bisphenol A; bisphenols such as bisphenol A, bisphenol F, bisphenol S; adducts of the above-mentioned alicyclic diol with an alkylene oxide such as ethylene oxide, propylene oxide, butylenes oxide; adducts of the above-mentioned bisphenol with an alkylene oxide such as ethylene oxide, propylene oxide, butylenes oxide. In particular, alkylene glycol having 2 to 12 carbon atoms and adducts of bisphenol with an alkylene oxide are preferably used, and a mixture thereof is more preferably used. Specific examples of the polyhydric alcohol (TO) higher than trihydric alcohol include multivalent aliphatic alcohol having tri-octa hydric or higher hydric alcohol such as glycerin, trimethylolethane, trimethylolpropane, pentaerythritol and sorbitol; phenol having tri-octa hydric or higher hydric alcohol such as trisphenol PA, phenolnovolak, cresol-novolak; and adducts of the above-mentioned polyphenol having tri-octa hydric or higher hydric alcohol with an alkylene oxide.

As the polycarboxylic acid (PC), dicarboxylic acid (DIC) and polycarboxylic acids having 3 or more valences (TC) can be used. A dicarboxylic acid (DIC) alone, or a mixture of the dicarboxylic acid (DIC) and a small amount of polycarboxylic acid having 3 or more valences (TC) is preferably used. Specific examples of the dicarboxylic acids (DIC) include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the polycarboxylic acid having 3 or more valences (TC) include aromatic polycarboxylic acids having 9 to 20 carbon atoms such as trimellitic acid and pyromellitic acid. The polycarboxylic acid (PC) can be formed from a reaction between the above-mentioned acids anhydride or lower alkyl ester such as methyl ester, ethyl ester and isopropyl ester.

The polyhydric alcohol (PO) and the polycarboxylic acid (PC) are mixed such that the equivalent ratio ([OH]/[COOH]) between the hydroxyl group [OH] of the poly hydric alcohol (PO) and the carboxylic group [COOH] of the polycarboxylic acid (PC) is typically from 2/1 to 1/1, preferably from 1.5/1 to 1/1 and more preferably from 1.3/1 to 1.02/1.

In the condensation polymerization reaction of a polyhydric alcohol (PO) with a polyhydric carboxylic acid (PC), the polyhydric alcohol (PO) and the polyhydric carboxylic acid (PC) are heated to a temperature from approximately 150° C. to approximately 280° C. in the presence of a known esterification catalyst, e.g., tetrabutoxy titanate or dibutyltineoxide. The generated water is distilled off with pressure being lowered, if necessary, to obtain a polyester resin containing a hydroxyl group. The hydroxyl value of the polyester resin is preferably 5 or more while the acid value of polyester is usually between 1 and 30, and preferably between 5 and 20. When a polyester resin having such an acid value is used, the residual toner is easily negatively charged. In addition, the affinity of the toner for recording paper can be improved, resulting in improvement of low temperature fixability of the toner. However, a polyester resin with an acid value above 30 can adversely affect stable charging of the residual toner, particularly when the environmental conditions vary.

The weight-average molecular weight of the polyester resin is from 10,000 to 400,000, and more preferably from 20,000 to 200,000. A polyester resin with a weight-average molecular weight between 10,000 lowers the offset resistance of the residual toner while a polyester resin with a weight-average molecular weight above 400,000 lowers the temperature fixability.

A urea-modified polyester is preferably included in the toner in addition to unmodified polyester produced by the above-described condensation polymerization reaction. The urea-modified polyester is produced by reacting the carboxylic group or hydroxyl group at the terminal of a polyester obtained by the above-described condensation polymerization reaction with a polyisocyanate compound (PIC) to obtain polyester prepolymer (A) having an isocyanate group, and then reacting the prepolymer (A) with amines to crosslink and/or extend the molecular chain.

Specific examples of the polyisocyanate compound (PIC) include aliphatic polyvalent isocyanate such as tetra methylenediisocyanate, hexamethylenediisocyanate, 2,6-diisocyanate methyl caproate; alicyclic polyisocyanate such as isophoronediisocyanate, cyclohexylmethane diisocyanate; aromatic diisocyanate such as tolylenediisocyanate, diphenylmethene diisocyanate; aroma-aliphatic diisocyanate such as α,α,α',α'-tetramethylxylene diisocynate; isocaynates; the above-mentioned isocyanats blocked with phenol derivatives, oxime, caprolactam; and a combination of two or more of them.

The polyisocyanate compound (PIC) is mixed such that the equivalent ratio ([NCO]/[OH]) between an isocyanate group [NCO] and a hydroxyl group [OH] of polyester having the isocyanate group and the hydroxyl group is typically from 5/1 to 1/1, preferably from 4/1 to 1.2/1, and more preferably from 2.5/1 to 1.5/1. A ratio of [NCO]/[OH] higher than 5 can deteriorate low-temperature fixability. As for a molar ratio of [NCO] below 1, if the urea-modified polyester is used, then the urea content in the ester is low, lowering the hot offset resistance.

The content of the constitutional unit obtained from a polyisocyanate (PIC) in the polyester prepolymer (A) is from 0.5% to 40% by weight, preferably from 1% to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,31-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

Suitable polyester resins for use in the toner of the present invention may include a urea-modified polyesters. The urea-modified polyester may include a urethane bonding as well as a urea bonding. The molar ratio (urea/urethane) of the urea bonding to the urethane bonding is from 100/0 to 10/90, preferably from 80/20 to 20/80, and more preferably from 60/40 to 30/70. When the molar ratio of the urea bonding is less than 10%, hot offset resistance of the resultant toner deteriorates.

The urea modified polyester is produced by, for example, a one-shot method. Specifically, a polyhydric alcohol (PO) and a polyhydric carboxylic acid (PC) are heated to a temperature of approximately 150° C. to approximately 280° C. in the presence of the known esterification catalyst, e.g., tetrabutoxy titanate or dibutyltineoxide to be reacted. The resulting water is distilled off with pressure being lowered, if necessary, to obtain a polyester containing a hydroxyl group. Then, a polyisocyanate (PIC) is reacted with the polyester obtained above a temperature of from approximately 40° C. to approximately 140° C. to prepare a polyester prepolymer (A) having an isocyanate group. The prepolymer (A) is further reacted with an amine (B) at a temperature of from 0° C. to approximately 140° C. to obtain a urea-modified polyester.

At the time of reacting the polyisocyanate (PIC) with a polyester and reacting the polyester prepolymer (A) with the amines (B), a solvent may be used, if necessary. Specific examples of the solvent include solvents inactive to the isocyanate (PIC), e.g., aromatic solvents such as toluene, xylene; ketones such as acetone, methyl ethyl ketone, methyl isobutyl ketone; esters such as ethyl acetate; amides such as dimethyl formamide, dimethyl acetatamide; and ethers such as tetrahydrofuran.

If necessary, a reaction terminator may be used for the crosslinking reaction and/or extension reaction of a polyester prepolymer (A) with an amine (B), to control the molecular weight of the resultant urea-modified polyester. Specific examples of the reaction terminators include a monoamine such as diethylamine, dibutylamine, butylamine, lauryl amine, and blocked substances thereof such as a ketimine compound.

The weight-average molecular weight of the urea-modified polyester is not less than 10,000, preferably from 20,000 to 10,000,000 and more preferably from 30,000 to 1,000,000. A molecular weight of less than 10,000 deteriorates the hot offset resisting property. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester resin can be included with the urea-modified polyester. A combination thereof improves low temperature fixability of the resultant toner and glossiness of color images produced by the image forming apparatus 1, and using the combination is more preferable than using the urea-modified polyester alone. It is noted that the unmodified polyester may contain polyester modified by a chemical bond other than the urea bond.

It is preferable that the urea-modified polyester at least partially mixes with the unmodified polyester resin to improve the low temperature fixability and hot offset resistance of the resultant toner. Therefore, the urea-modified polyester preferably has a structure similar to that of the unmodified polyester resin.

A mixing ratio between the urea-modified polyester and polyester resin is from 20/80 to 95/5 by weight, preferably from 70/30 to 95/5 by weight, more preferably from 75/25 to 95/5 by weight, and even more preferably from 80/20 to 93/7 by weight. When the weight ratio of the urea-modified polyester is less than 5%, the hot offset resistance deteriorates, and in addition, it is difficult to impart a good combination of high temperature preservability and low temperature fixability of the toner.

The toner binder preferably has a glass transition temperature (Tg) of from 45° C. to 65° C., and preferably from 45° C. to 60° C. When the glass transition temperature is less than 45° C., the high temperature preservability of the toner deteriorates. When the glass transition temperature is higher than 65° C., the low temperature fixability deteriorates.

Since the urea-modified polyester can exist on the surfaces of the mother toner particles, the toner of the present invention has better high temperature preservability than conventional toners including a polyester resin as a binder resin even though the glass transition temperature is low.

The method for manufacturing the toner is described.

The toner of the present invention is produced by the following method, but the manufacturing method is not limited thereto.

(Preparation of Toner)

First, a colorant, unmodified polyester, polyester prepolymer having isocyanate groups and a parting agent are dispersed into an organic solvent to prepare a toner material liquid.

The organic solvent should preferably be volatile and have a boiling point of 100° C. or below because such a solvent is easy to remove after the formation of the toner mother particles. More specific examples of the organic solvent includes one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent such as toluene and xylene; and a hydrocarbon halide such as methylene chloride, 1,2-dichloroethane, chloroform or carbon tetrachloride is preferably used. The amount of the organic solvent to be used should preferably 0 parts by weight to 300 parts by weight for 100 parts by weight of polyester prepolymer, more preferably 0 parts by weight to 100 parts by weight for 100 parts by weight of polyester prepolymer, and even more preferably 25 parts by weight to 70 parts by weight for 100 parts by weight of polyester prepolymer.

The toner material liquid is emulsified in an aqueous medium in the presence of a surfactant and organic fine particles.

The aqueous medium for use in the present invention is water alone or a mixture of water with a solvent which can be mixed with water. Specific examples of such a solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

The content of the aqueous medium is typically from 50 to 2,000 parts by weight, and preferably from 100 to 1,000 parts by weight, per 100 parts by weight of the toner constituents. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase.

Various dispersants are used to emulsify and disperse an oil phase in an aqueous liquid including water in which the toner constituents are dispersed. Specific examples of such dispersants include surfactants, resin fine-particle dispersants, etc.

Specific examples of the dispersants include anionic surfactants such as alkylbenzenesulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di(octylaminoethyle)glycine, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium, 3-{omega-fluoroalkanoyl(C6-C8)-N-ethylamino}-1-propanesulfonate, fluoroalkyl(C11-C20) carboxylic acids and their metal salts, perfluoroalkylcarboxylic acids (7C-13C) and their metal salts, perfluoroalkyl(C4-C12) sulfonate and their metal salts, perfluorooctanesulfonic acid diethanol amides, N-propyl-N-(2-hydroxyethyl-)perfluorooctanesulfone amide, perfluoroalkyl(C6-C10) sulfoneamidepropyltrimethylammonium salts, salts of perfluoroalkyl (C6-C10)-N-ethylsulfonylglycin, monoperfluoroalkyl(C6-C16)e-thylphosphates, etc.

Specific examples of the marketed products of such surfactants having a fluoroalkyl group include SARFRON (Registered) S-111, S-112 and S-113, which are manufactured by ASAHI GLASS CO., LTD.; FLUORAD (Registered) FC-93, FC-95, FC-98 and FC-129, which are manufactured by SUMITOMO 3M LTD.; UNIDYNE (Registered) DS-101 and DS-102, which are manufactured by DAIKIN INDUSTRIES, LTD.; MEGAFACE (Registered) F-110, F-120, F-113, F-191, F-812 and F-833 which are manufactured by DAINIPPON INK AND CHEMICALS, INC.; ECTOP EF-102, 103, 104, 105, 112, 123A, 123B, 306A, 501, 201 and 204, which are manufactured by TOHCHEM PRODUCTS CO., LTD.; FUTARGENT (Registered) F-100 and F150 manufactured by NEOS; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6-C10)sulfone-amidepropyltrimethylammonium salts, benzalkonium salts, benzetonium chloride, pyridinium salts, imidazolinium salts, etc. Specific examples of the marketed products thereof include SARFRON (Registered) S-121 (manufactured by ASAHI GLASS CO., LTD.); FLUORAD (Registered) FC-135 (manufactured by SUMITOMO 3M LTD.); UNIDYNE DS-202 (manufactured by DAIKIN INDUSTRIES, LTD.); MEGAFACE (Registered) F-150 and F-824 (manufactured by DAINIPPON INK AND CHEMICALS, INC.); ECTOP EF-132 (manufactured by TOHCHEM PRODUCTS CO., LTD.); FUTARGENT (Registered) F-300 (manufactured by NEOS); etc.

Resin fine particles are added to stabilize toner source particles formed in aqueous solvent. The resin fine particles are preferably added such that the coverage ratio thereof on the surface of a toner source particle can be within 10% through 90%. For example, such resin fine particles may be methyl polymethacrylate particles of 1 μm and 3 μm, polystyrene particles of 0.5 μm and 2 μm, poly(styrene-acrylonitrile) particles of 1 μm, commercially, PB-200 (manufactured by KAO Co.), SGP, SGP-3G (manufactured by SOKEN), technopolymer SB (manufactured by SEKISUI PLASTICS CO., LTD.), micropearl (manufactured by SEKISUI CHEMICAL CO., LTD.) or the like.

Also, an inorganic dispersant such as calcium triphosphate, calcium carbonate, titanium oxide, colloidal silica, and hydroxyapatite may be used.

Further, it is possible to stably disperse toner constituents in water using a polymeric protection colloid in combination with the inorganic dispersants and/or particulate polymers mentioned above.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, (β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The dispersion method is not particularly limited, and conventional dispersion facilities, e.g., low speed shearing type, high speed shearing type, friction type, high pressure jet type and ultrasonic type dispersers can be used. Among them, the high speed shearing type dispersion methods are preferable for preparing a dispersion including grains with a grain size of 2 μm to 20 μm. The number of rotation of the high speed shearing type dispersers is not particularly limited, but is usually 1,000 rpm (revolutions per minute) to 30,000 rpm, and preferably 5,000 rpm to 20,000 rpm. While the dispersion time is not limited, it is usually 0.1 minute to 5 minutes for the batch system. The dispersion temperature is usually 0° C. to 150° C., and preferably 40° C. to 98° C. under a pressurized condition.

At the same time as the production of the emulsion, an amine (B) is added to the emulsion to be reacted with the polyester prepolymer (A) having isocyanate groups.

The reaction causes the crosslinking and/or extension of the molecular chains to occur. The elongation and/or crosslinking reaction time is determined depending on the reactivity of the isocyanate structure of the prepolymer (A) and amine (B) used, but is typically from 10 minutes to 40 hours, and preferably from 2 hours to 24 hours. The reaction temperature is typically from 0° C. to 150° C., and preferably from 40° C. to 98° C. In addition, a known catalyst such as dibutyltinlaurate and dioctyltinlaurate can be used. The amines (B) are used as the elongation agent and/or crosslinker.

After the above reaction, the organic solvent is removed from the emulsion (reaction product), and the resultant particles are washed and then dried. Thus mother toner particles are prepared.

To remove the organic solvent, the entire system is gradually heated in a laminar-flow agitating state. In this case, when the system is strongly agitated in a preselected temperature range, and then subjected to a solvent removal treatment, fusiform mother toner particles can be produced. Alternatively, when a dispersion stabilizer, e.g., calcium phosphate, which is soluble in acid or alkali, is used, calcium phosphate is preferably removed from the toner mother particles by being dissolved by hydrochloric acid or similar acid, followed by washing with water. Further, such a dispersion stabilizer can be removed by a decomposition method using an enzyme.

Then a charge control agent is penetrated into the mother toner particles, and inorganic fine particles such as silica, titanium oxide etc. are added externally thereto to obtain the toner of the present invention.

When preparing the toner by mixing the mother toner particles with an external additive and the lubricant, the external additive and the lubricant may be added individually or at the same time. The mixing operation of the external additive and the lubricant with the mother toner particles can be carried out using a conventional mixer, which preferably includes a jacket to control the inner temperature of the mixer. Suitable mixers are V-type mixers, rocking mixers, Ledige mixers, nauter mixers and Henschel mixers. Preferably, the rotational speed, mixing time and/or mixing temperature are optimized to prevent embedding of the external additive into the mother toner particles and forming a thin layer on the surface of the lubricant.

Thus, a toner having a small particle size and a sharp particle distribution can be obtained easily. Moreover, by controlling the stirring conditions when removing the organic solvent, the particle shape of the particles can be controlled so as to be any shape between perfectly spherical and rugby ball shape. Furthermore, the conditions of the surface can also be controlled so as to be any condition between smooth surface and rough surface such as the surface of pickled plum.

The thus prepared toner is mixed with a magnetic carrier to be used as a two-component developer. In this case, the toner is included in the two-component developer in an amount of from 1 part to 10 parts by weight per 100 parts by weight of the carrier. As an alternative, the toner of the present invention can be used as a one-component magnetic or nonmagnetic developer.

Further, the image forming unit 2 provided to the image forming apparatus 1 may serve as a process unit that is detachable with respect to the image forming apparatus 1 and integrally include the photoconductor 5, the lubricating unit 17, the cleaning unit 15, and at least one of the charging unit 14 and the developing unit 10. The lubricating unit 17 includes the brush roller 17*a*. The brush roller 17*a* slidably moves on a solid lubricant or the molded lubricant 17*b* having a bar shape, scrapes lubricant therefrom, and applies the scraped lubricant to the surface of the photoconductor 5. The toner used in the process unit or the image forming unit 2 of the image forming apparatus 1 has the lubricant thereon and supplies the lubricant to the photoconductor 5. With the above-described process unit, the photoconductor 5 used in the process unit can have a longer life. Further, maintenance of the photoconductor 5 may easily be done by replacing the process unit to a new one, which can increase convenience.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

an image carrier configured to carry an image on a surface thereof;

a cleaning unit including a cleaning blade and configured to remove residual toner remaining on the surface of the image carrier with the cleaning blade; and an application unit including a brush roller having an elastic part including an elastic member and a fiber part including modified cross-section fibers, the application unit configured to use the brush roller to scrape a molded lubricant into scraped lubricant and apply the scraped lubricant to the surface of the image carrier, wherein each modified cross-section fiber has a convex, polygonal cross-section and a diameter smaller than a diameter of the elastic member; and a height of the elastic member from a surface of a cored bar of the brush roller is lower than a height of the fibers therefrom.

2. The image forming apparatus according to claim 1, wherein the brush roller is configured to include a first fiber part having a first fibrous member and a second fiber part having a second fibrous member, the first fibrous member of the first fiber part having a thickness smaller than a thickness of the second fibrous member of the second fiber part.

3. The image forming apparatus according to claim 2, wherein the second fibrous member of the second fiber part is shorter in length than the first fibrous member of the first fiber part.

4. The image forming apparatus according to claim 1, wherein the image carrier has a coefficient of friction equal to or less than 0.4.

5. The image forming apparatus according to claim 1, wherein the lubricant includes fatty acid metal salts having metallic materials and fatty acids.

6. The image forming apparatus according to claim 1, wherein a ratio of a circumferential velocity of the photoconductor to a circumferential velocity of the brush roller is in a range of from 0.8:1 to 1.2:1.

7. The image forming apparatus according to claim 1, wherein the image forming apparatus is configured to use toner containing particles having an average circularity of from approximately 0.92 to approximately 1.00.

8. The image forming apparatus according to claim 1, wherein the image forming apparatus is configured to use toner containing particles having a shape factor SF-1 in a range of from approximately 100 to approximately 180, and a shape factor SF-2 in a range of from approximately 100 to approximately 180.

9. The image forming apparatus according to claim 1, wherein the image forming apparatus is configured to use toner containing particles having a volume-based average particle diameter from approximately 3 μm to approximately 8 μm and a distribution of from approximately 1.00 to approximately 1.40, the distribution being defined by a ratio of the volume-based average particle diameter to a number-based average diameter.

10. The image forming apparatus according to claim 1, wherein:

the image forming apparatus is configured to use toner containing particles having a ratio of a major axis r1 to a minor axis r2 of from approximately 0.5 to approximately 1.0, and a ratio of a thickness r3 to the minor axis r2 of from approximately 0.7 to approximately 1.0; and $$r1 \geqq r2 \geqq r3.$$

11. The image forming apparatus according to claim 1, wherein the image forming apparatus is configured to use toner containing particles obtained from at least one of an elongation and a crosslinking reaction of toner composition comprising a polyester prepolymer having a function group including a nitrogen atom, a polyester, a colorant, and a releasing agent in an aqueous medium under resin fine particles.

12. The image forming apparatus of claim 1, wherein the modified cross-section fiber has a rectangular cross-section.

13. The image forming apparatus of claim 1, wherein the modified cross-section fiber has a pentagonal cross-section.

14. The image forming apparatus of claim 1, wherein the modified cross-section fiber has a triangular cross section.

15. A process unit detachable from an image forming apparatus, the process unit integrally comprising:

an image carrier configured to carry an image on a surface thereof;

an application unit including a brush roller and configured to use the brush roller to scrape a molded lubricant into a scraped lubricant and apply the scraped lubricant onto the image carrier, the brush roller including a fiber part and an elastic part including an elastic member mounted thereon and fibrous members of the fiber part including modified cross-section fibers, wherein each modified cross-section fiber has a convex, polygonal cross-section and a diameter smaller than a diameter of the elastic member, and a height of the elastic member from a surface of a cored bar of the brush roller is lower than a height of the fibers therefrom;

a cleaning unit including a cleaning blade and configured to remove residual toner remaining on the surface of the image carrier with the cleaning blade; and at least one of a charging unit configured to uniformly charge the surface of the image carrier and a developing unit configured to develop an image formed on the surface of the image carrier into a visible toner image.

* * * * *